US007789392B2

(12) United States Patent
Kishon

(10) Patent No.: US 7,789,392 B2
(45) Date of Patent: Sep. 7, 2010

(54) PUZZLE

(75) Inventor: Daniel Chaim Kishon, London (GB)

(73) Assignee: All in 1 Products Limited, Ealing Common, London (GB)

( * ) Notice: Subject to any disclaimer, the term of this patent is extended or adjusted under 35 U.S.C. 154(b) by 53 days.

(21) Appl. No.: 12/262,829

(22) Filed: Oct. 31, 2008

(65) Prior Publication Data

US 2009/0127785 A1 May 21, 2009

(30) Foreign Application Priority Data

Oct. 31, 2007 (GB) ..... 0721415.8

(51) Int. Cl.
*A63F 9/10* (2006.01)
*A63F 9/12* (2006.01)

(52) U.S. Cl. ..... 273/157 R

(58) Field of Classification Search ..... 273/157 R, 273/156, 153 R

See application file for complete search history.

(56) References Cited

U.S. PATENT DOCUMENTS 1,229,580 A * 6/1917 Brown ..... 273/157 R
1,964,007 A * 6/1934 Parks ..... 273/157 R
2,493,697 A 1/1950 Raczkowski
2,731,766 A * 1/1956 Rubin ..... 273/157 R
3,779,558 A 12/1973 Moreau
4,570,936 A * 2/1986 Meiser et al. ..... 273/157 R
4,943,063 A * 7/1990 Moreau ..... 273/157 R
5,683,086 A * 11/1997 Druckman et al. ..... 273/156
5,806,853 A * 9/1998 Druckman et al. ..... 273/156
6,276,684 B1 * 8/2001 Hershkovits et al. ..... 273/156
6,655,685 B2 * 12/2003 Tsai ..... 273/157 R

FOREIGN PATENT DOCUMENTS

GB 2309649 A 8/1997
GB 2333240 A 7/1999
GB 2422556 A 8/2006

OTHER PUBLICATIONS

UK Intellectual Property Office, "Combined Search and Examination Report," UK Intellectual Property Office, (Mar. 4, 2008).

* cited by examiner

*Primary Examiner*—Steven Wong
(74) *Attorney, Agent, or Firm*—Gable Gotwals

(57) ABSTRACT

The present invention relates to a puzzle and a method of assembling a puzzle from a plurality of planar puzzle pieces. More particularly, the invention relates to a puzzle having pieces which, when stacked upon each other on completion of the puzzle, define in relief a recognisable image (e.g. of a building or a character). The puzzle comprises a plurality of inter-engaging pieces, wherein: each puzzle piece has on a planar surface thereof a part of an image which is shown as a whole once the puzzle pieces are assembled together in a completed planar jigsaw puzzle; each puzzle piece has a first edge of a first shaped profile; and when the puzzle pieces are removed from the completed planar jigsaw puzzle in a predetermined sequence related to positioning of the puzzle pieces in the completed planar jigsaw puzzle and stacked in the predetermined sequence then the first edges of the stacked puzzle pieces together define in relief a recognisable image on a first side of the stack.

15 Claims, 14 Drawing Sheets

110

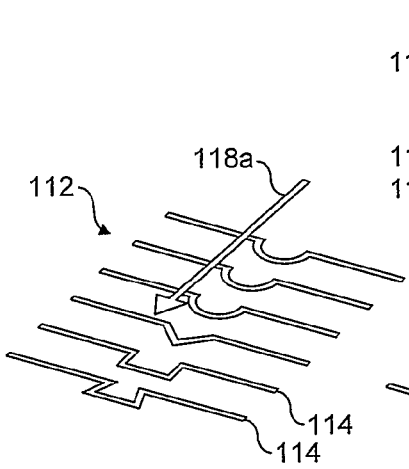
FIG. 5a
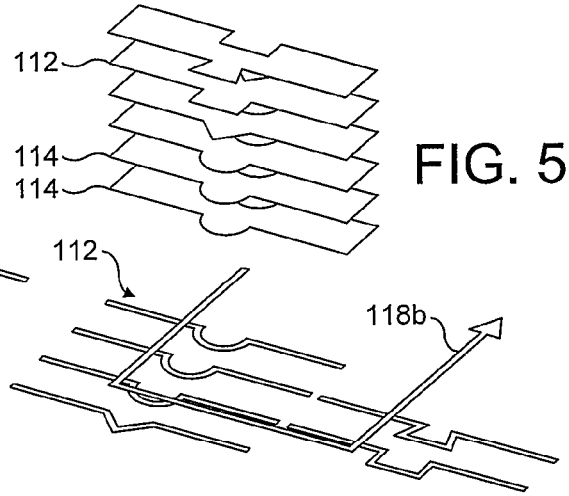
FIG. 5b
FIG. 5c
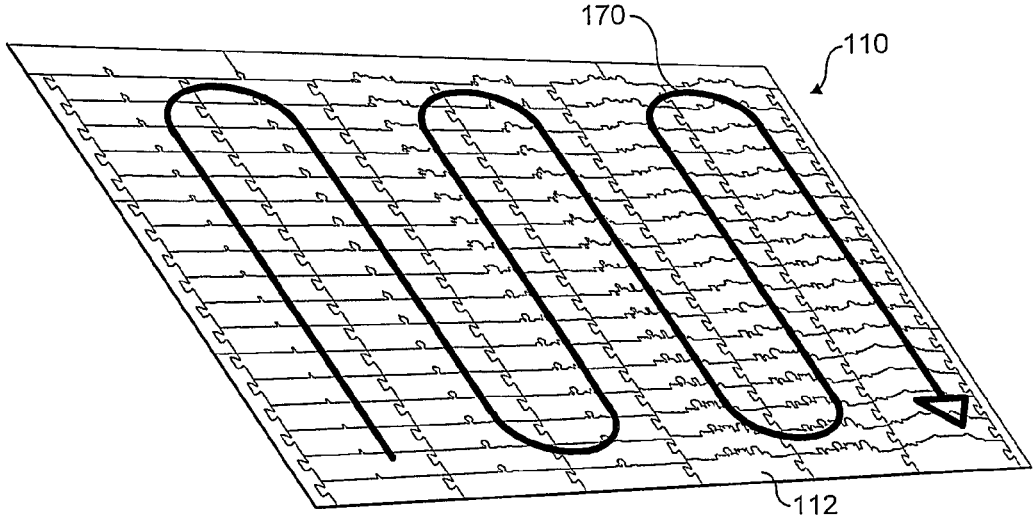
FIG. 6

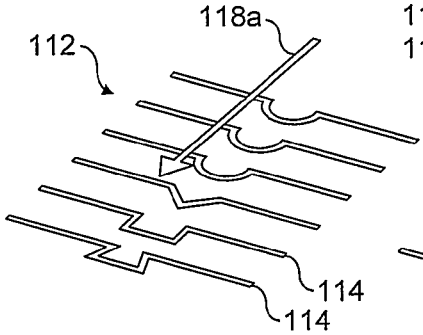
FIG. 7a
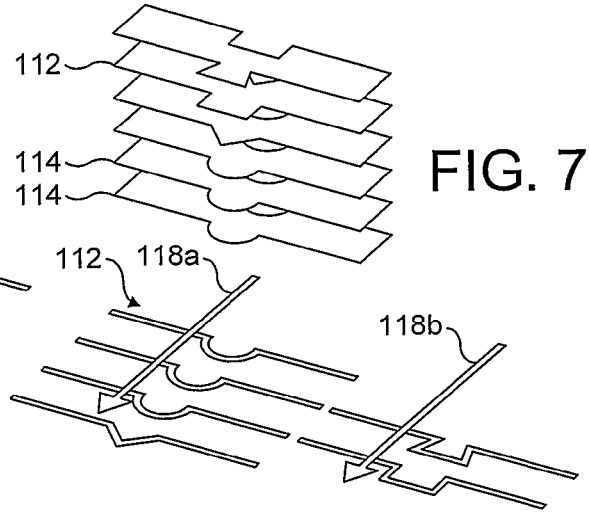
FIG. 7b
FIG. 7c
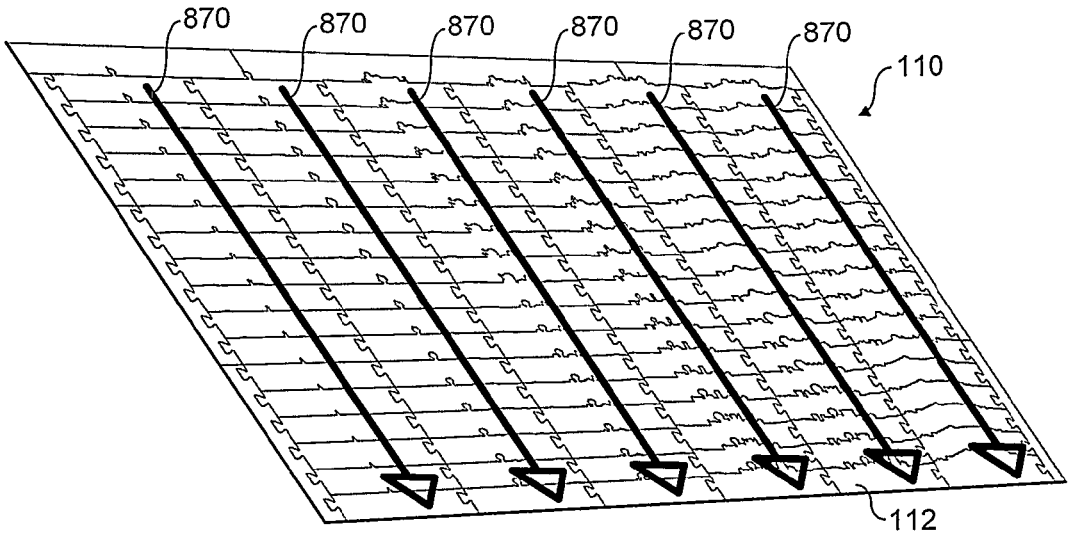
FIG. 8

PUZZLE

CROSS-REFERENCE TO RELATED APPLICATIONS

This application claims priority to Great Britain Patent Application No. GB0721415.8, filed Oct. 31, 2007.

FIELD OF THE INVENTION

The present invention relates to a puzzle and, more particularly, to a puzzle having pieces which, when stacked upon each other on completion of the puzzle, define in relief a recognisable image (e.g. of a building or a character).

BACKGROUND OF THE INVENTION

Jigsaw puzzles are well known. In a jigsaw puzzle, the objective is to fit together a number of segments in a predetermined manner so as to form a coherent picture or image.

In a prior art document, U.S. Pat. No. 2,493,697, there is shown a puzzle formed of several small jigsaw-type sections. Each jigsaw section can be assembled to form a layer. The different layers are then placed in order onto a base and post to form a three-dimensional figure.

In a further prior art document, U.S. Pat. No. 3,779,558, there is shown a puzzle where pieces can be assembled in a 2-D puzzle or stacked in layers to form a 3-D figure. The order in which the puzzle pieces are assembled in the 2-D puzzle is completely independent of the order in which they are stacked in the three dimensional puzzle. The puzzle shown uses spikes to secure stacked pieces in place. This means that holes are formed in the puzzle pieces and it is therefore not possible to completely reform a perfect planar image. As shown in the patent, the puzzle pieces do not perfectly abut in the stacked puzzle and gaps are left.

SUMMARY OF THE INVENTION

According to a first embodiment of the present invention, there is provided a puzzle comprising a plurality of planar puzzle pieces, wherein: the planar puzzle pieces can be assembled together into one or more planar jigsaw puzzle(s), each planar piece having on a first planar surface thereof a part of an image which is shown as a whole in the/one of the assembled planar jigsaw puzzle(s); each planar puzzle piece has a first edge of a first profile shaped such that when the puzzle pieces are stacked in a correct sequence then the first edges of the stacked puzzle pieces together define in relief a recognisable image on a first side of the stack; and the puzzle pieces are shaped such that the correct stacking sequence is directly related to the locations of the puzzle pieces in the assembled planar jigsaw puzzle(s).

According to a second embodiment of the present invention, there is provided a method of assembling a puzzle from a plurality of planar puzzle pieces, each puzzle piece having on a first planar surface thereof a part of an image and each planar puzzle piece having a first edge of a first shaped profile, the method comprising: first assembling the puzzle pieces together to form one or more a completed planar jigsaw puzzle(s), and then removing puzzle pieces from the completed planar jigsaw puzzle in a sequence dictated by positioning of the puzzle pieces in the completed planar jigsaw puzzle(s) and then stacking the pieces in the pre-determined sequence, so that the first edges of the stacked puzzle pieces together define in relief a recognisable three-dimensional figure on a first side of the stacked puzzle pieces.

In order to assemble the 3D puzzle of the invention it is a necessary first step to complete one or more 2D puzzles using the puzzle pieces, since it is in solving the 2D puzzle that the order of stacking of the puzzle pieces in the 3D puzzle is revealed.

BRIEF DESCRIPTION OF THE DRAWINGS

Preferred embodiments of the present invention will now be described, by way of example only, with reference to the accompanying drawings, in which:

FIGS. 5*a* to 5*c* are perspective schematic illustrations of aspects of the first embodiment of puzzle;

FIG. 6 is an illustration of a completed planar puzzle of the first embodiment, with an indication of the order in which the puzzle pieces are to be removed from the completed planar puzzle for stacking;

FIGS. 7*a*, 7*b*, 7C are perspective schematic illustrations of aspects of a second embodiment of puzzle;

FIG. 8 is an illustration of a completed planar puzzle of the second embodiment, with an indication of the order in which the puzzle pieces are to be removed from the completed planar puzzle for stacking;

DETAILED DESCRIPTION OF THE PREFERRED EMBODIMENT

Figure 1:
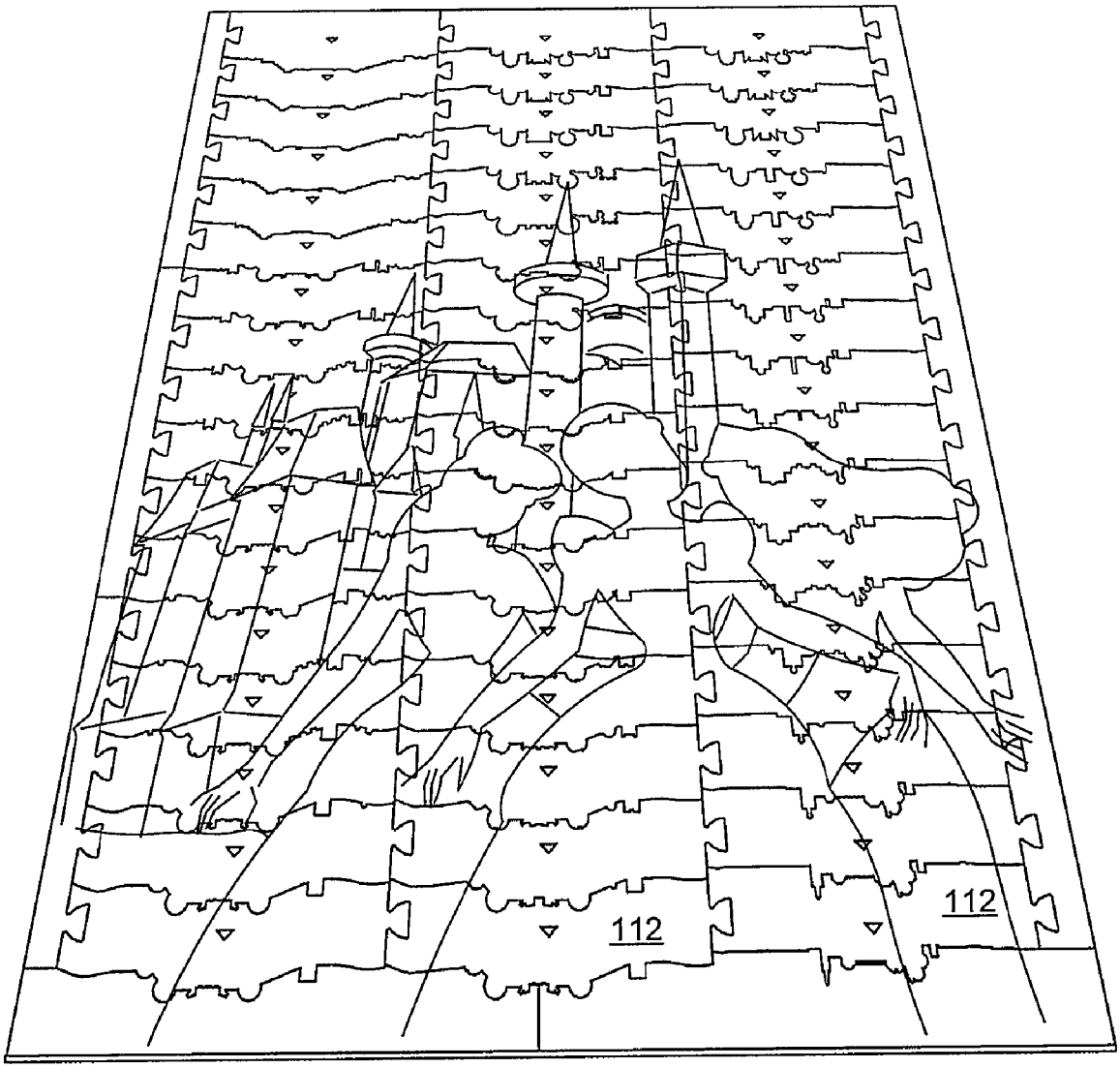
FIG. 1 is a perspective view of an embodiment of a puzzle according to the present invention in which the pieces have been inter-engaged.

With reference to FIG. 1, there can be seen a puzzle 110 comprising a plurality of interlocking pieces 112. Each piece 112 has a part of an image on a surface. The pieces 112 are interlocked in a completed planar jigsaw puzzle to form an overall image.

Figure 2:
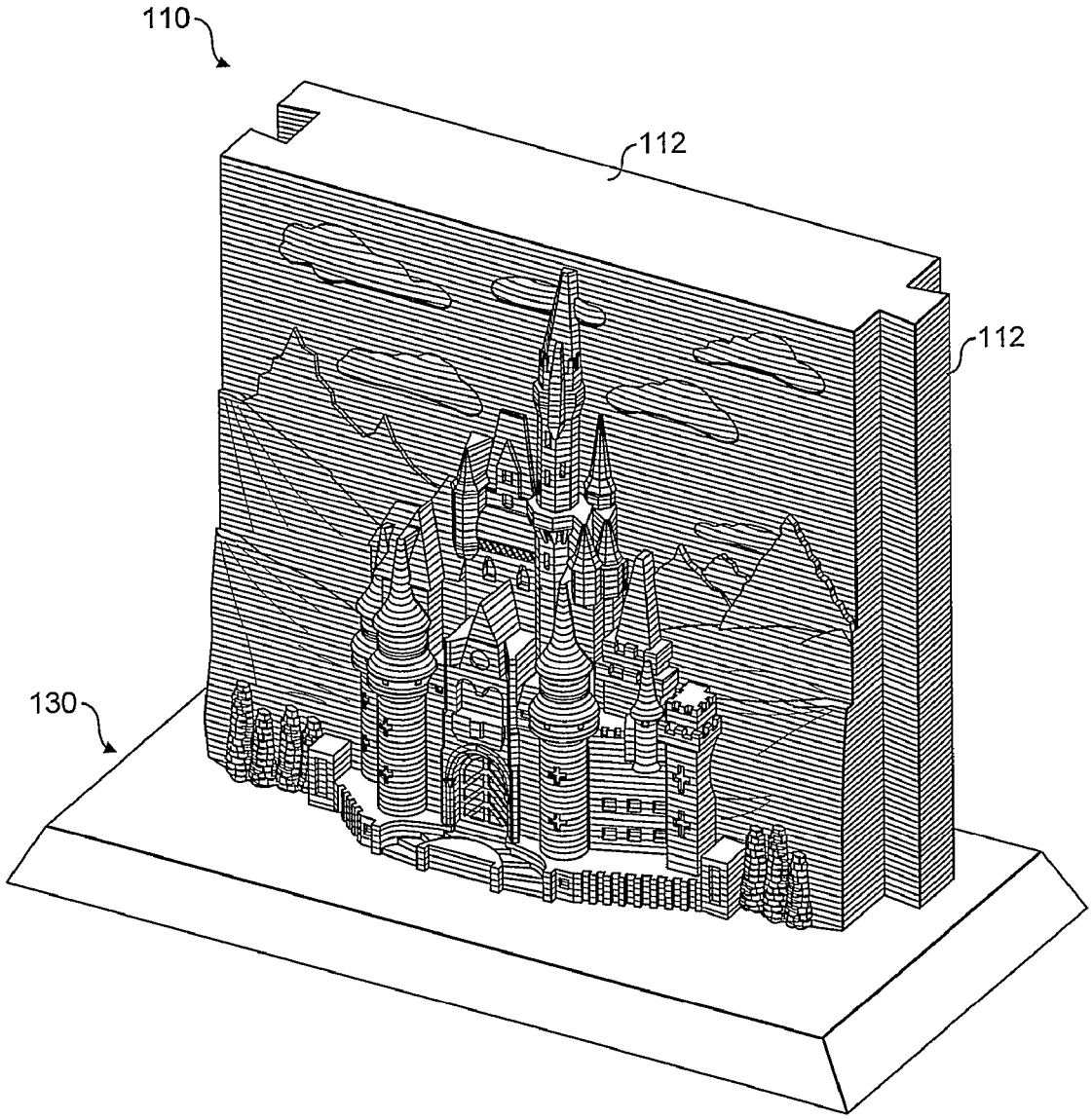
FIG. 2 is a perspective view of the assembled puzzle forming a three-dimensional figure.

FIG. 2 shows the pieces 112 of the completed planar puzzle disassembled from the planar puzzle and stacked on top of each other to form an assembled puzzle 110. The pieces 112 have been stacked one on top of the other in a particular order to create in relief a recognisable image. In this case the three-dimensional figure formed in relief is an image of a castle. Many other three-dimensional figures could be designed.

The pieces 112 when stacked are supported on a base 130. One or more core(s) (not shown) extend substantially vertically upwardly from the base 130. The core(s) help(s) to align the pieces 112, and may additionally secure the pieces 112 in correct alignment. The core(s) preferably has/have a triangular cross-section, which is uniform along its/their length.

Figure 3:
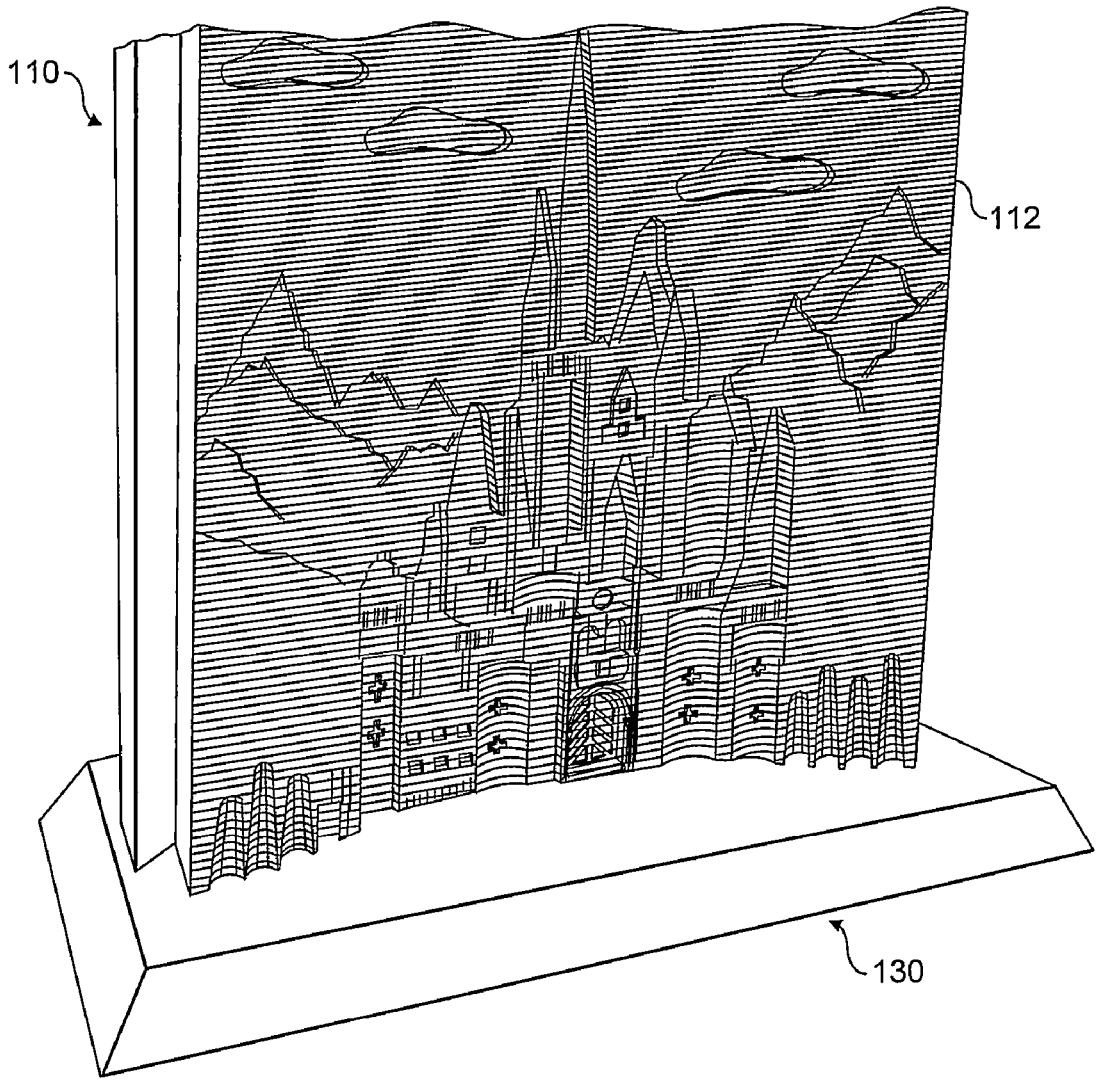
FIG. 3 is rear perspective view of the assembled puzzle of FIG. 2.

FIG. 3 shows a rear view of the completed stacked puzzle 110. It can be seen that the three-dimensional figure extends forwardly of a background surface on the front of the assembled puzzle 110, whilst on the rear of the puzzle 110 the image is formed as a recess in a background surface. The image on the rear of the puzzle corresponds to the image on the front surface except that the image is shifted by one layer. This recess is inherent due to the shape of the pieces 112, as will described in more detail.

Figure 4:
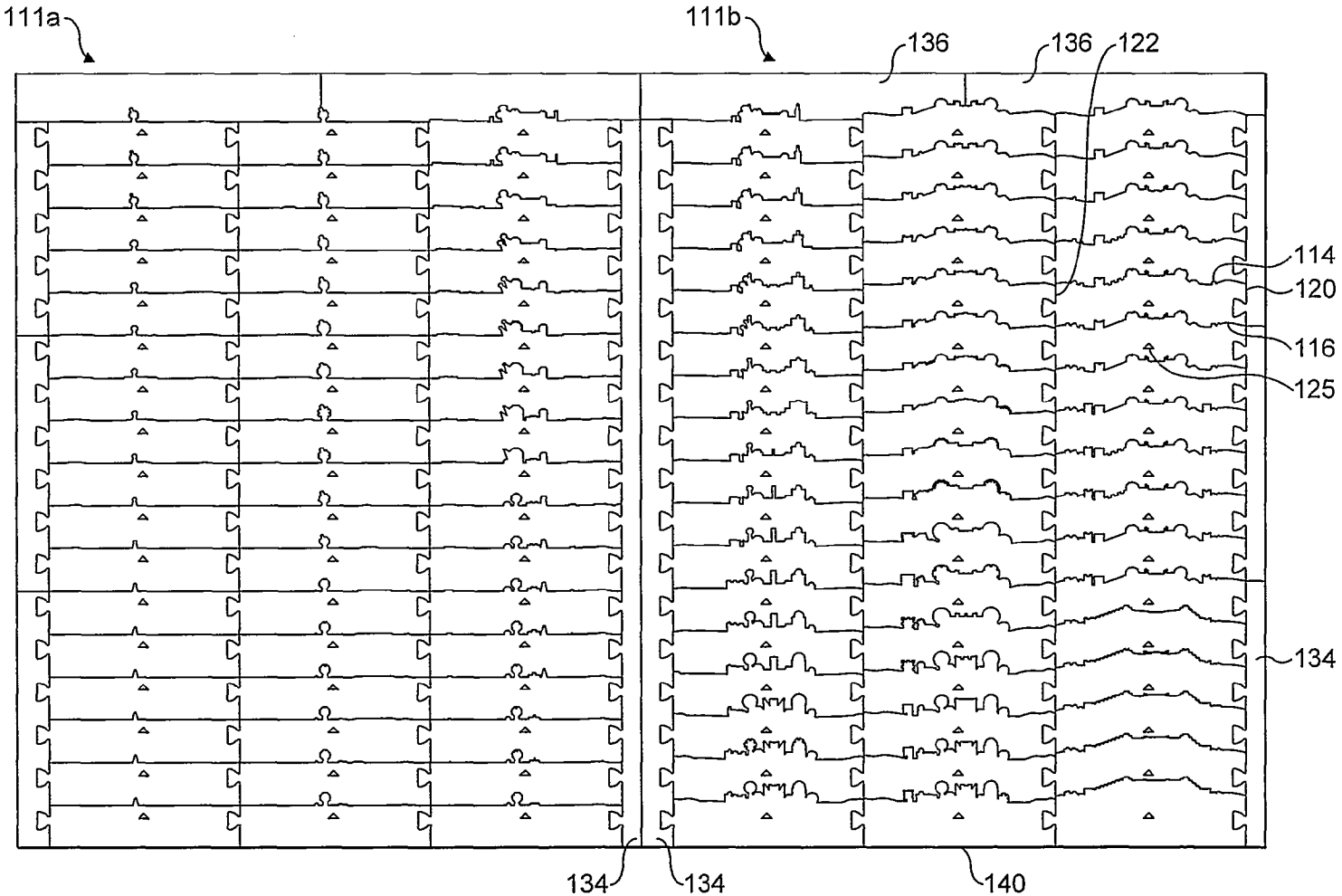
FIG. 4 is a front view of a first embodiment of puzzle formed in two sections.

FIG. 4 shows a puzzle 110 in which the pieces have been arranged into an interlocking two-dimensional array in a completed planar puzzle.

The completed planar puzzle 110 forms two separate images, with the relevant sections referred to as sections 111*a*, 111*b*. Each section 111*a*, 111*b* shows a different image on a planar surface. The pieces 112 from both sections 111*a*, 111*b* are combined in order to form the completed three-dimensional figure. For instance, each may comprise 50 pieces so that the completed puzzle has 100 pieces.

Each jigsaw piece 112, for example piece 13, has a first edge 114 having a first shaped profile. The first edge 114 will be the edge forming the front surface of the stacked puzzle. The piece 13 has a second edge 116 defining a second shaped profile. The second edge 116 is on an opposite side of the piece 13 to the first edge 114. The second edge 116 has a shape complementary to an abutting edge of an adjoining piece 12, when the pieces 12, 13 are placed together to show the picture. The complementary shapes allow the pieces 12, 13 to abut each other in columns.

The shaped profiles of the first edge 114 and second edge 116 of a particular piece are independent of each other. As illustrated, the jigsaw piece 12 has a first edge which abuts the second edge 116 of the piece 13. Thus, the second edge 116 of piece 13 is complementary to the curved profile of the first edge of piece 12.

The pieces 12 each have a third edge (120 for piece 13) and a fourth edge (122 for piece 13). The third edge 120 comprises an interlocking cut-out, and the fourth edge 122 comprises a male interlocking part as illustrated. Alternatively, the third edge 120 may comprise a male interlocking part and the fourth edge 122 comprise a female interlocking cut-out part, or a piece 112 may have third and fourth edges both defining a male interlocking part or both defining a female interlocking cut-out part. The fourth edge 122 as shown has a male interlocking part which securely interlocks in a matching female interlocking cut-out of adjacent piece in an adjacent column, as is known from conventional jigsaw puzzles.

The pieces 10, 34, 35, 68, 69, 102 on the periphery of the puzzle 110 each have a second edge 140 which is straight. However, the applicant envisage that the second edge 140 of the pieces could be shaped to be complementary with the first edge of a piece at the end of an adjacent column, e.g. the edge 140 of the piece 34 could be shaped to be complementary with the front edge of piece 17.

Frame sections 134, 136 extend along the sides of each section of jigsaw. The frame sections 134 each have an inner edge having interlocking male part or "lug" (or female cut-out) part configured to interlock with the third or fourth edges of pieces 112. The fourth surface 20 of the jigsaw piece 13 described above has a female cut-out which receives a male part extending from the frame 134. The lugs and cut-outs are provided on only two of the four sides of each puzzle piece. They provide for a definite interference fit between pieces in the completed planar puzzle, the pieces are secured together and interlocked rather than simply abutted with each other.

The frame sections 134 may have a surface forming part of the image, such that the whole image is shown when the pieces 112 are correctly assembled in the frames 134. References to the 'whole image' should be construed as the image shown either with all the pieces 112 only, or with the pieces 112 and the frame sections 134, 136.

The puzzle 110 has frame sections 136 adjacent the outer edges of pieces 17, 18, 51, 52, 85, 86. The frame sections 136 have a linear outer edge and an inner edge of a shape complementary to the outer edges of adjacent jigsaw pieces 17, 18, 51, 52, 85, 86.

Each piece 112 is provided with an aperture 125. The aperture 125 is triangular in shape. The aperture 125 is for receiving a core extending from the base assembly 130, in order to ensure a correct alignment of the piece 112 in the assembled state, and to prevent further slipping 112 of the pieces 12 from that correct alignment.

Figure 21:
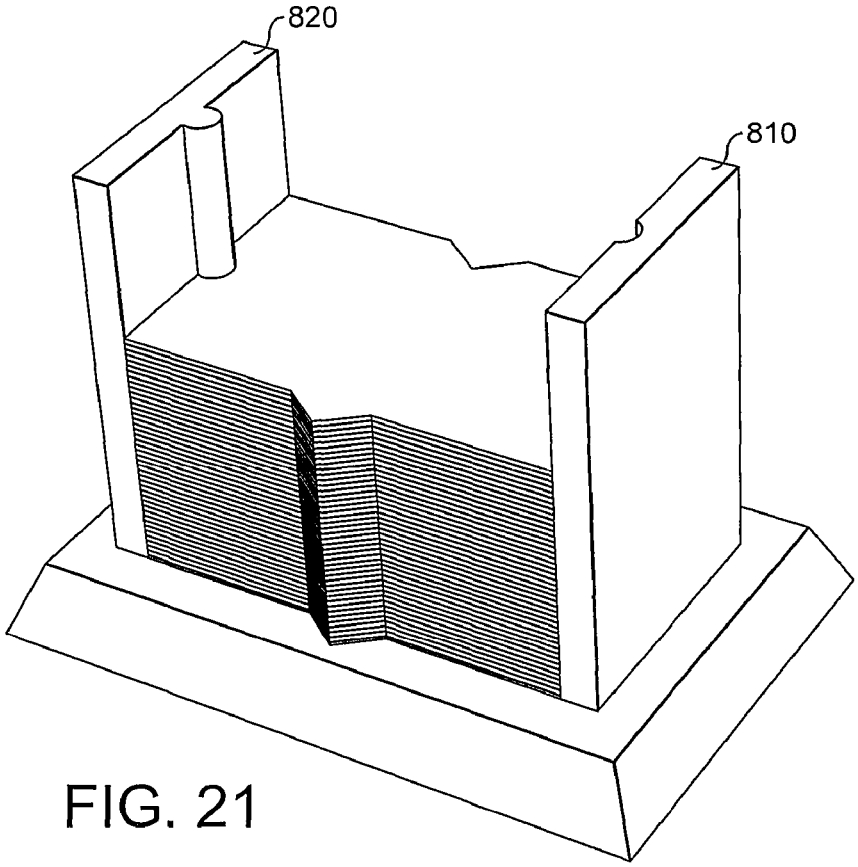
FIG. 21 shows a frame which is configured to receive stacked puzzle pieces.

The first and second surfaces 114, 116 can be of a wide variety of shapes. The shapes of the first and second surfaces 114, 116 must be chosen such that opposite edges of each piece have at least a minimum separation, to prevent the piece 112 from being broken into two parts. The male interlocking part on the fourth surface 122 may be provided with a perforated line of weakness where it joins the main body of the jigsaw piece, in order to allow removal of the male part. Removal of the male part would leave a straight edge at the fourth edge 122. This may be done whilst assembling the pieces into the three-dimensional figure, in order to obtain a straight edge at the side of the three-dimensional figure. Alternatively, as shown in FIG. 21, a frame could be provided with one vertical frame member 810 having a slot shaped to receive the lugs of the jigsaw pieces in the stack and another vertical frame member 820 having a ridge which protrudes into a slot formed by aligned cut-outs in edges of the puzzle pieces of the stack; in this case, no apertures 125 or core members would be needed.

FIGS. 5*a* to 5*c* are a schematic illustration of six pieces 112. FIG. 5*a* shows the front edges 114 of each of the pieces 112 when assembled together in a completed planar jigsaw puzzle in a single column. In order to form the three-dimensional figure, the pieces are removed in a sequential order, illustrated by the arrow 118*a*. The pieces are then stacked in this same sequential order in forming a stacked puzzle.

FIG. 5*b* illustrates pieces 112 of two adjacent columns. The pieces 112 are removed in the direction of the arrow 118*b*. The pieces are removed in one direction along a first column and then pieces from an adjacent second column are removed in an opposite direction by starting at the end of the second column adjacent to the last piece removed from the first column. The puzzle 110 may comprise one, two or three or more columns of pieces 112. If a plurality of columns are present, they are generally removed in the order illustrated in FIG. 5*b*, that is starting the next column at an end adjacent to an end at which the previous column ended. The order of removal can therefore be considered to follow a boustrophedon track.

FIG. 5*c* shows the pieces 112 stacked vertically one on top of the other. Each of the first edges 114 faces forwardly. The completed puzzle 110 has a depth (i.e. from front vertical surface to rear vertical surface) of only one piece 112. Thus, all of the first faces edges 114 are visible at once when assembled.

In use, firstly the pieces 112 are assembled as a completed planar jigsaw puzzle. The parts of image printed on each of the pieces can be used to correctly arrange the pieces 112. Once the planar jigsaw puzzle has been completed, the pieces 112 are removed in a predetermined sequence, and stacked in this order on the base 130 (shown in FIG. 10). It is by solving the planar jigsaw puzzle that the solving of the stacked puzzle is made possible. The puzzler must complete the planar puzzle in order to reveal the sequence in which the puzzle pieces are to be subsequently stacked.

Figure 9:
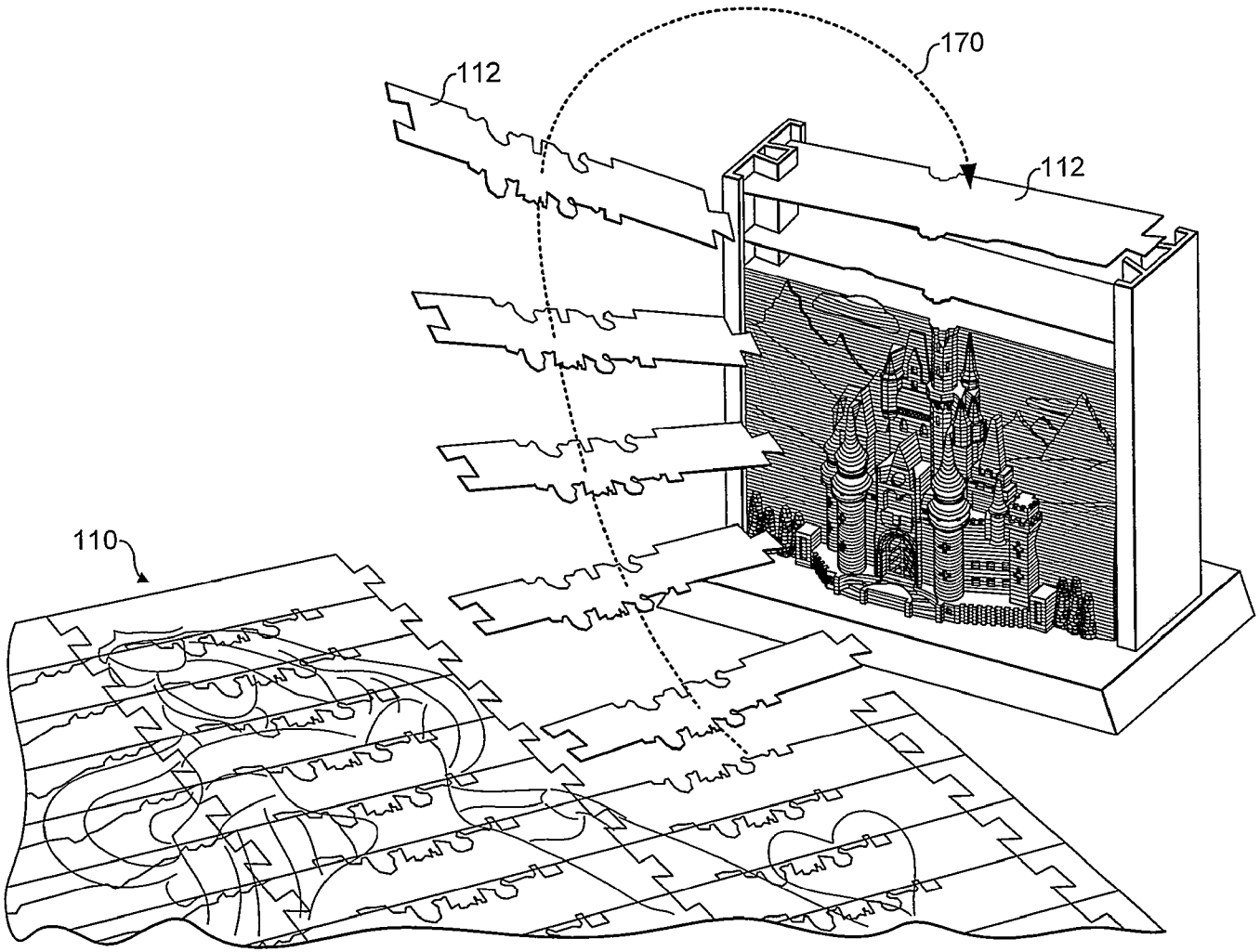
FIG. 9 is an illustration indicating how the planar puzzle pieces are subsequently stacked to form a stacked puzzle.
Figure 11:
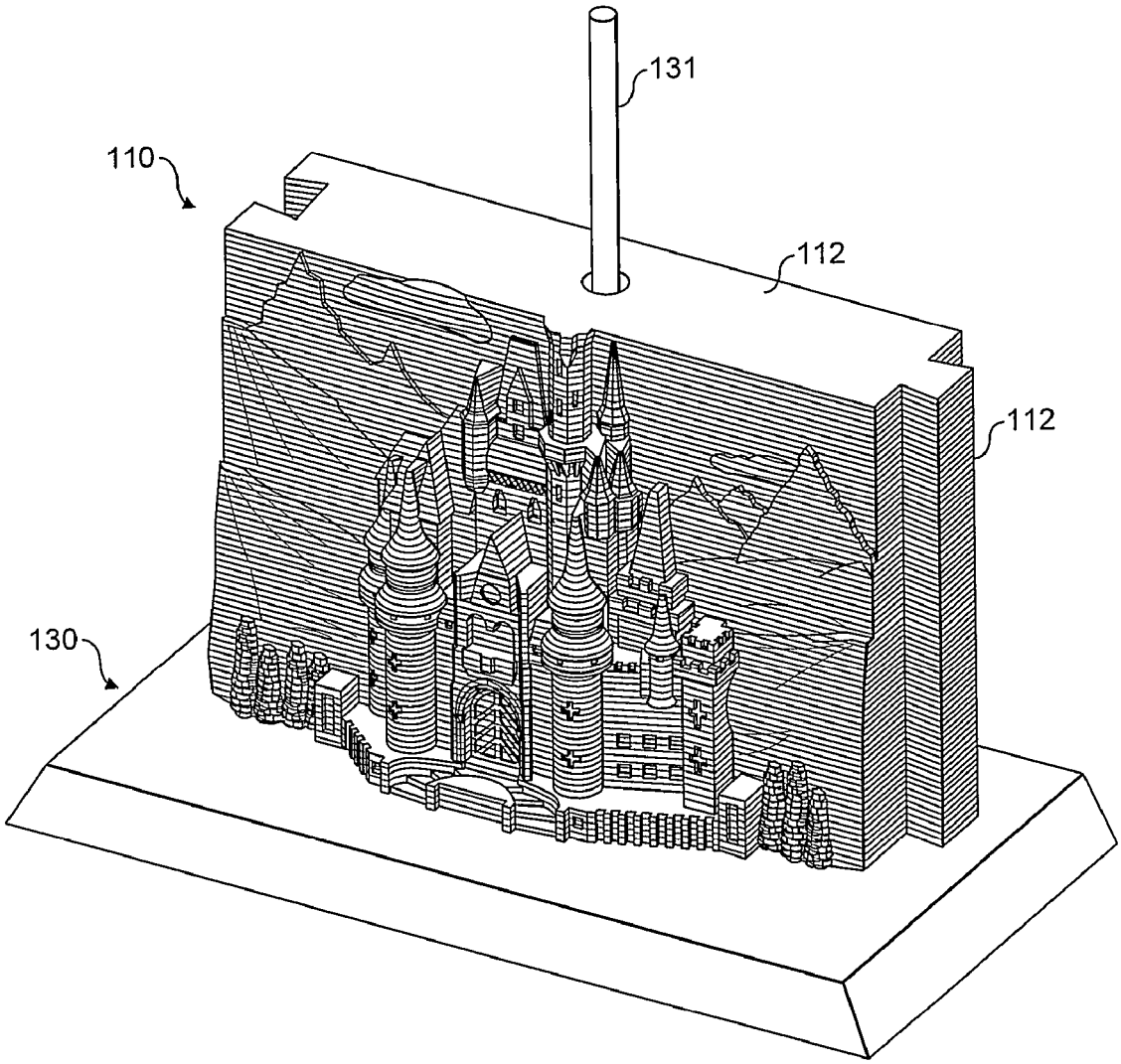
FIG. 11 shows a part-assembled stacked puzzle.

A core 131 extends upwardly from the base 130 and passes through the apertures 122 in the puzzle piece 112, as can be seen in FIGS. 9 and 11. Once all the pieces 112 are stacked on the base 130, a recognisable image is formed in relief on two vertical surfaces. In order to determine how the pieces are to be stacked, the player must first solve the planar jigsaw puzzle using the puzzle pieces, then the puzzle pieces are disassembled from the completed planar puzzle in a predetermined order related to positioning of the puzzle pieces in the completed planar jigsaw puzzle and stacked in this order on the base to form the completed puzzle, in which a recognisable image is provided in relief by the shaped edges of the puzzle pieces. Typically, each puzzle piece 112 will be provided on one planar surface with a section of the image displayed on the completed puzzle and on the opposite planar surface with a plain colour as the pieces 112 will be inverted when transferred from the planar puzzle to the stack, so that the plain coloured side faces upwards and presents the a consistent colour to the viewed figure when viewed from above.

FIG. 6 shows a mostly completed planar jigsaw puzzle 110 comprising a single image formed by roughly 100 pieces (there is no central frame section dividing the puzzle in two) and an arrow 170 showing the order in which puzzle pieces are disassembled from the planar puzzle to form a stacked puzzle, as indicated in FIGS. 7 and 9, with a recognisable image provided in relief. The planar jigsaw puzzle 110 has six columns and the predetermined order dictates removal of pieces sequentially along a column and the moving to the next column to repeat the sequential removal of pieces from that column. Typically the first and last pieces to be removed from the planar jigsaw puzzle (respectively the bottom and top pieces of the stacked puzzle) will have only one shaped edge (with the opposite edge straight) whilst all the other pieces will have a pair of shaped edges. The frame sections described previously are not used in the stacked puzzle. Instead of removing the puzzle pieces firstly down one column and then up the next, as shown in FIG. 6, it may be preferred to remove puzzle pieces in a consistent direction (e.g. top to bottom) from each column and this is shown in FIGS. 7*a*, 7*b*, 7*c* and 8, where the arrows 870 show that the pieces are removed sequentially from each column consistently top to bottom to form the stacked puzzle. Puzzle pieces could also be removed consistently bottom to top for each column. Furthermore, puzzle pieces could be removed in order sequentially along a row rather than along a column, either in a boustrophedon manner or consistently left to right or consistently right to left.

FIG. 4 not only shows the completed planar puzzle (as described above), but also shows a single sheet as die-cut in manufacture of the puzzle. All the puzzle pieces 112 will be cut from a single sheet of material, typically cardboard, in a single cutting operation. Above the planar puzzle comprises in effect two fifty (or roughly fifty) piece puzzles having two sections of two different images.

Figure 14:
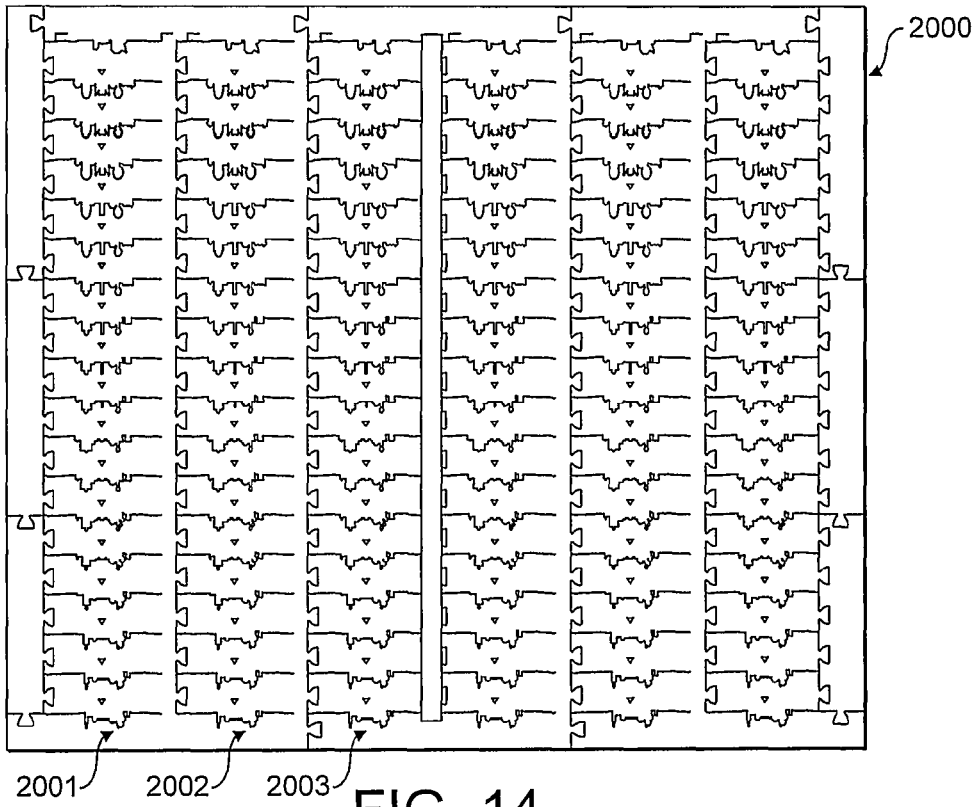
FIG. 14 shows a die-cut sheet for an embodiment of a puzzle in which a first set of 50 pieces together display a first image and a second set of 50 pieces display a second image.

A second such puzzle 2000 is illustrated in FIG. 14 which shows a die-cut sheet for forming a puzzle in which the pieces of three columns 2001, 2002, 2003 form a first sub-set of puzzle pieces which together display a first image, while the puzzle pieces of columns 2004, 2005, 2006 form a second sub-set of puzzle pieces which together display a second image.

Figure 15:
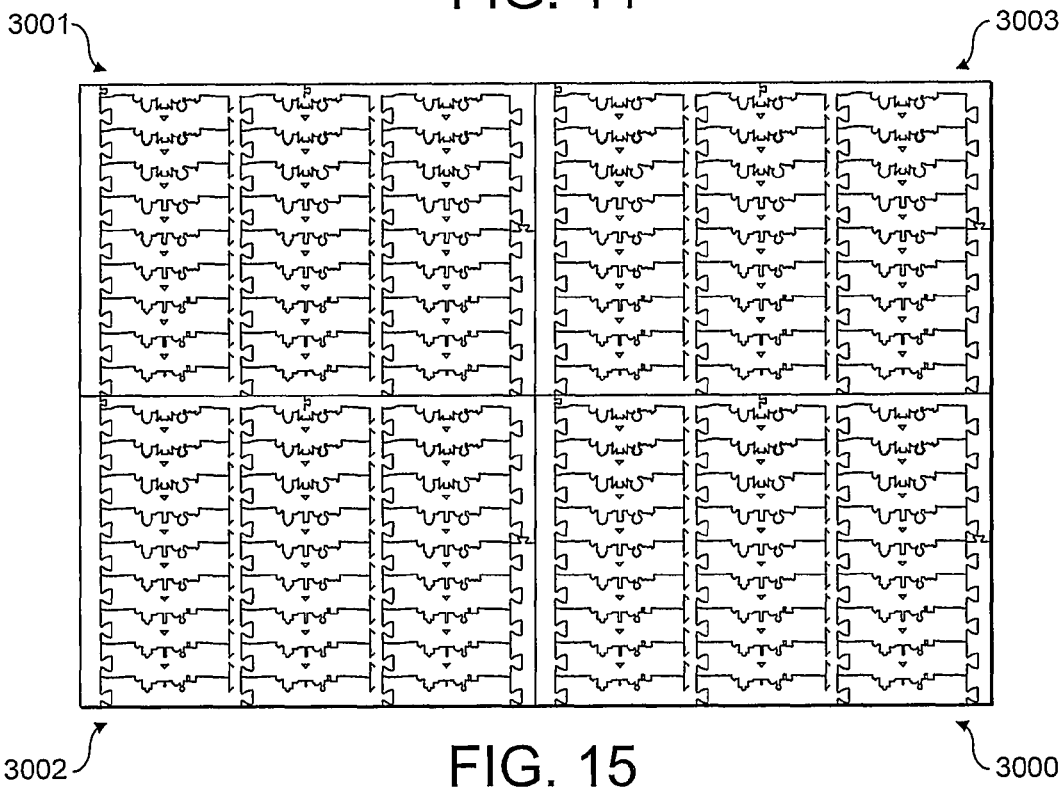
FIG. 15 shows a die-cut for a puzzle in which a first set of 25 pieces together display a first image, a second set of 25 pieces together display a second image, a third set of 25 pieces together display a third image and a fourth set of 25 pieces together display a fourth image.

For a puzzle easier to solve (e.g. by children) the puzzle could have four twenty-five (or roughly twenty five) piece sections each with a different image, the frame having a cruciform central section separating the four sections; such a puzzle is shown in FIG. 15 in which a puzzle 3000 has a first sub-set 3001 of a puzzle with roughly 25 pieces which together display a second image, a third sub-set 3003 of roughly 25 pieces which together display a third image and a fourth sub-set 3004 of roughly 25 pieces which together display a fourth image. In such a case the pre-determined sequence of removal of pieces from the completed planar puzzle can be contained within each sub-set or extend in columns across sub-sets, e.g. a single column comprising pieces from sub-sets 3001 and 3002.

Figure 13:
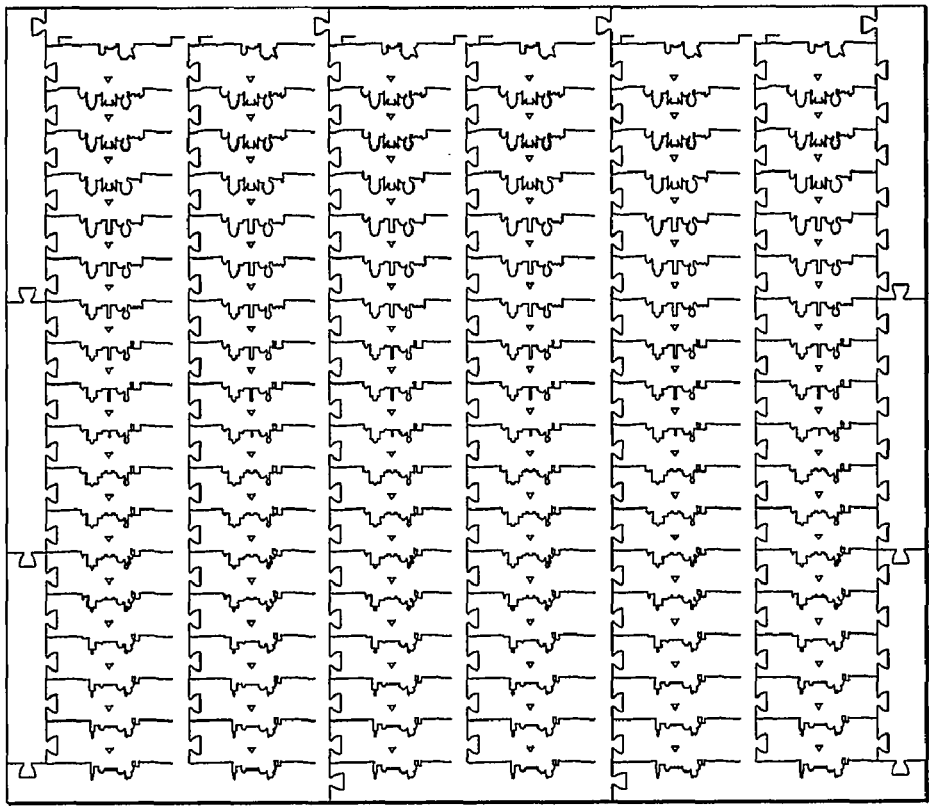
FIG. 13 shows a die-cut sheet for an embodiment of a puzzle in which 100 jigsaw pieces together display a single image.
Figure 18:
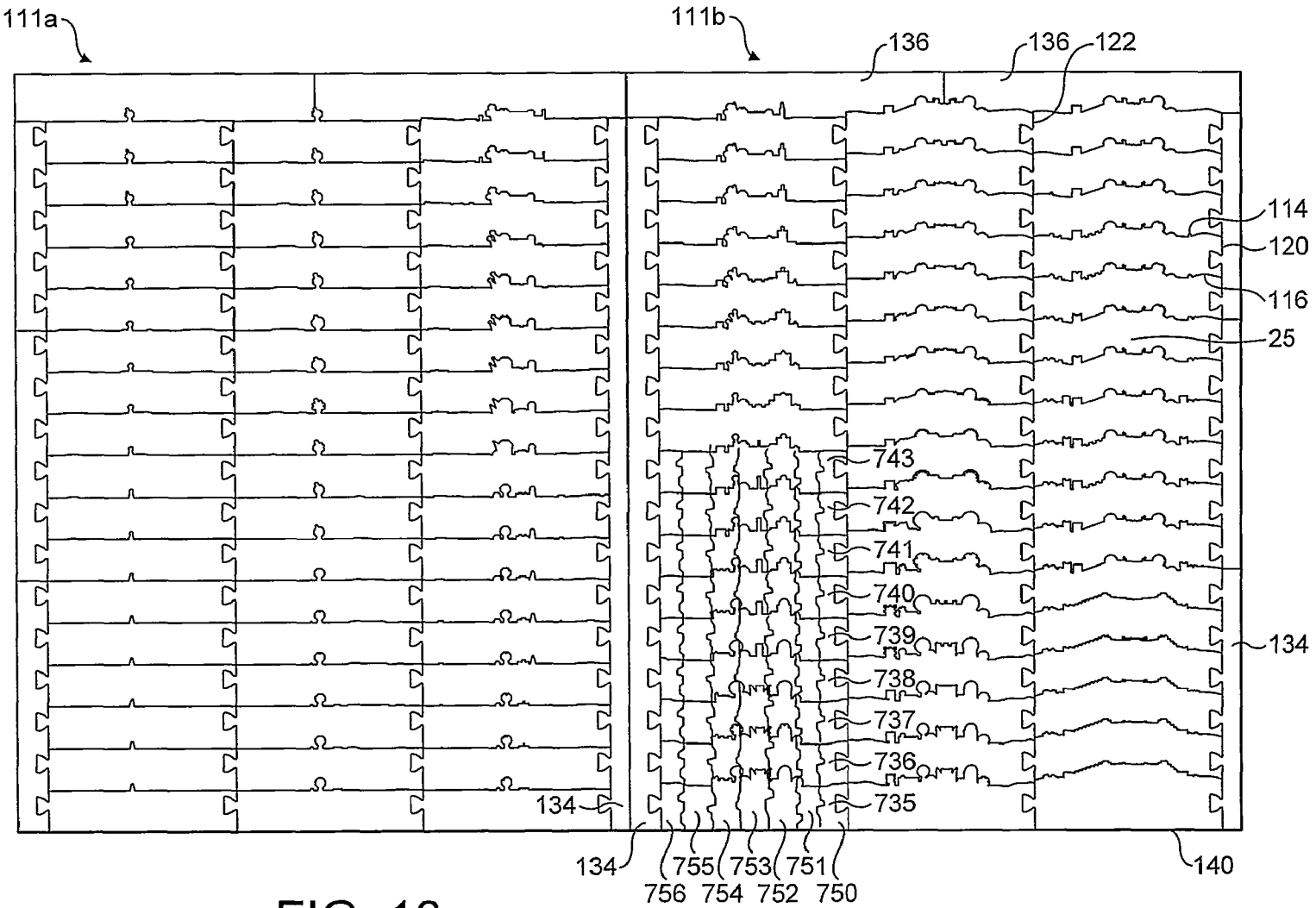
FIG. 18 shows a plan view of a further embodiment of puzzle formed in two dimensions.
Figure 19:
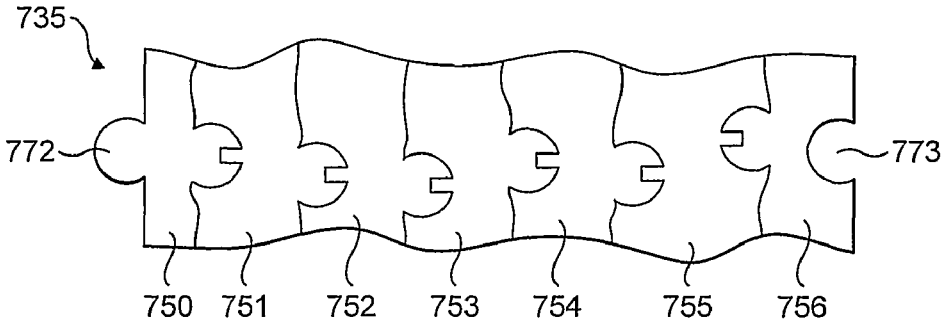
FIG. 19 shows an assembled layer of a 3D puzzle.
Figure 20A:
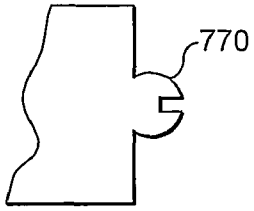
FIGS. 20*a* and 20*b* show differently shaped puzzle pieces.
Figure 20B:
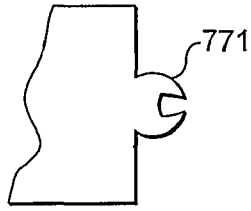

For a puzzle more difficult to solve a single image is printed across the whole of the die cut sheet (as shown in FIG. 6 or FIG. 13). For an even harder puzzle, each of the single pieces in FIG. 6 could itself comprise a plurality (e.g. four or five) of sub-pieces to be assembled together. This possibility is shown with reference to FIGS. 18 and 19. In FIG. 18, for clarity, only some of puzzle pieces 735-743 are shown comprising a plurality of sub-pieces but each puzzle component illustrated could be formed from a plurality of sub-pieces. Thus a 100 piece (approximately) puzzle would become a four or five hundred piece (approximately) puzzle. For instance, puzzle piece 735 is formed of sub-pieces 750-756 as illustrated in FIG. 18 and in more detail in FIG. 19. The player would know which puzzle sub-pieces form each layer by differences in lugs and cut-outs. The puzzle sub-pieces will form a component having a recognisable lug at one end and cut-out at the other end. The puzzle sub-pieces could simply abut each other without interlocking or could be provided with differently shaped lugs and cut-outs, as illustrated in FIGS. 19, 20*a*, and 20*b*. The lugs 770, 771 of FIGS. 20*a* and 20*b* are clearly different in shape to the lug 772 and cut-out 773 of the puzzle piece 735 in FIG. 19. The sub-pieces 750-756 are interconnected by lugs of the shape of lug 770, while the piece 735 as a whole has a differently shaped lug. A puzzler will take all the sub-pieces 750-756 together as one piece to stack as a layer in the 3D puzzle. The sub-pieces 750-756 all interlock and abut with no apertures left between them in the layer of the 3D puzzle.

Figure 10:
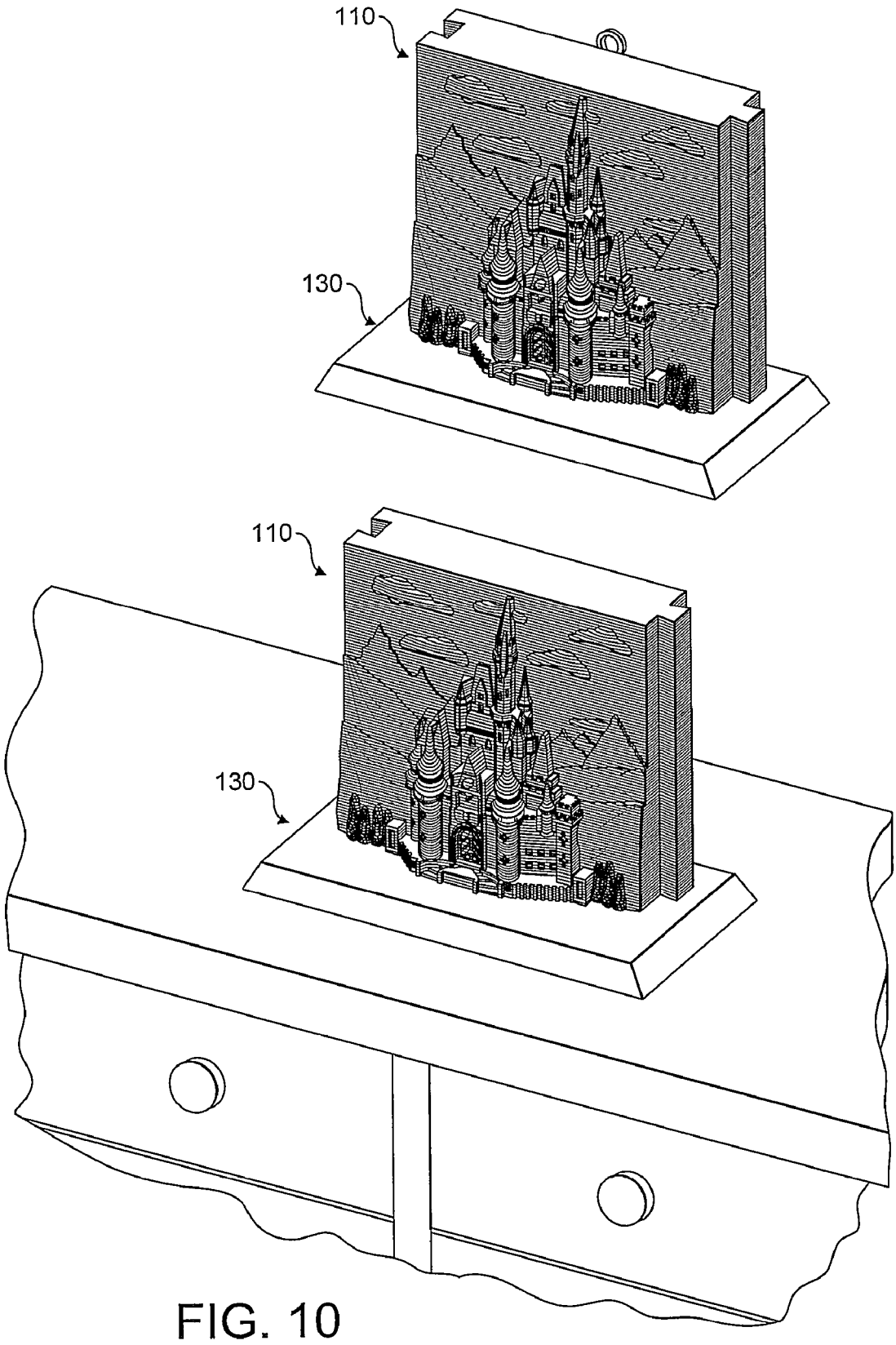
FIG. 10 illustrates how a completed stacked puzzle can be displayed.
Figure 12:
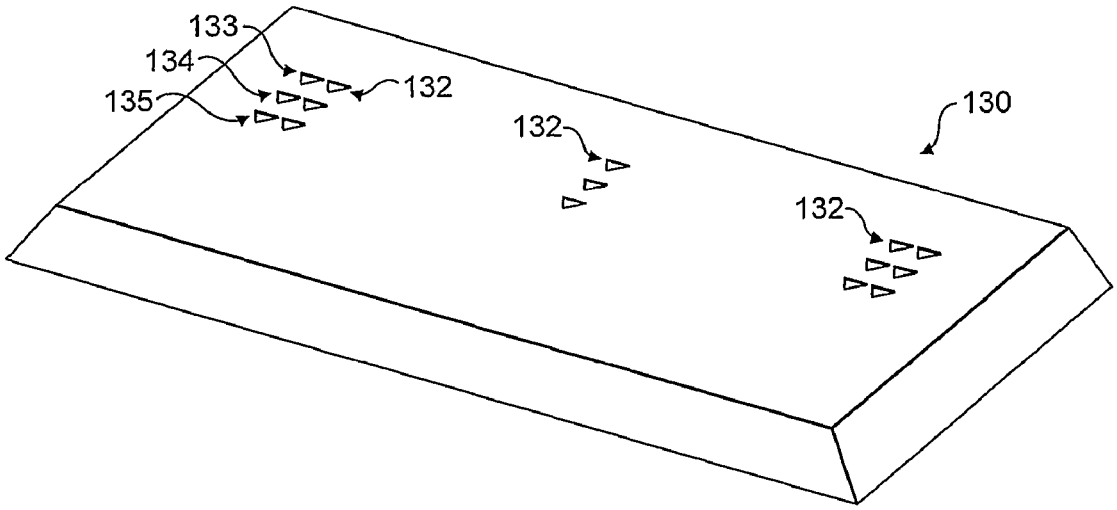
FIG. 12 shows a base.

A base 130 (see FIG. 12) can be provided with a plurality of apertures 132 extending in rows 133, 134, 135 across the base, to accommodate different core positions and puzzle depths. Such a base 130 enables the completed puzzle to be displayed free standing on a surface or hung on a wall; both options are shown in FIG. 10. Alternatively, a frame can be provided to surround the stacked puzzle pieces. The finished puzzle can be painted by the player, if desired; the puzzle can be supplied in a kit comprising not only the puzzle pieces, core(s) and base but also paints and applicators (e.g. brushes).

In the puzzles above, the edges of the stacked pieces in the 3D puzzle are visible and either display part of the image of the 2D puzzle or, when the pieces are inverted in the stacked puzzle, a constant colour when viewed from above. However, even in the latter case parts of the planar puzzle's image can be viewed on the edges of the stacked pieces from certain angles, which can be unappealing.

Figure 16A:
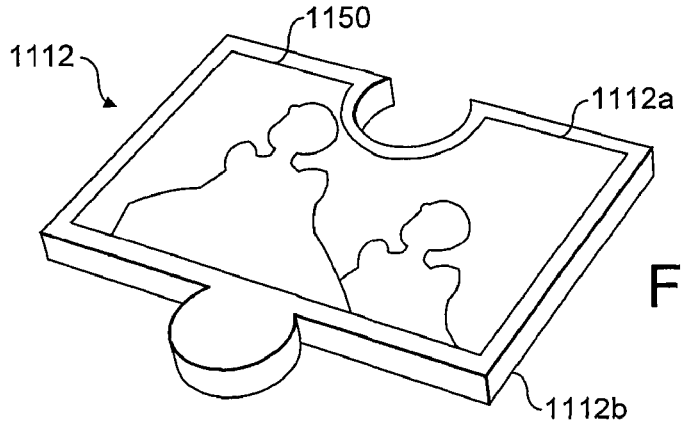
FIG. 16*a* shows a first planar surface of a piece formed in accordance with an embodiment of the invention.
Figure 16B:
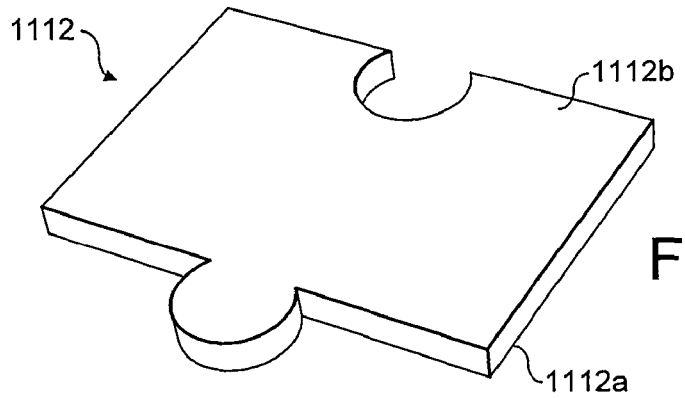
FIG. 16*b* shows a second planar surface of the piece of FIG. 16*a*.

With reference to FIGS. 16*a* and 16*b*, a further preferred embodiment of the present invention provides a puzzle having pieces 1112 with two planar surfaces 1112*a* and 1112*b*. On a first planar surface 1112*a*, a fragment of an image is printed, such that when the planar aspect of the puzzle is completed, the fragments of images together form a single large image. A separate border region 1150 of constant colour is provided on the first planar surface 1112*a* of each piece 1112.

Figure 17:
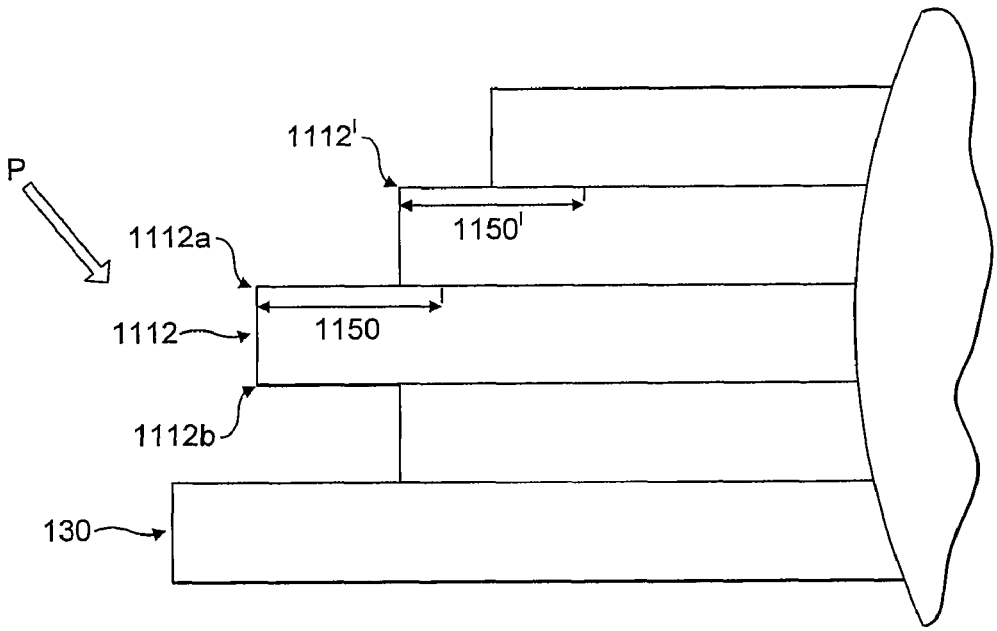
FIG. 17 shows a cross-sectional view of part of a completed three-dimensional stacked puzzle in accordance with an embodiment of the invention.

When the pieces are stacked to form a three-dimensional sculpture, some pieces 1112 protrude more than the adjacent pieces 1112, as shown in FIG. 17. The piece 1112 has a viewable area around its periphery. Since the surface 1112*b* has a constant colour and the border of surface 1112*a* has a constant colour, a pleasing constant colour is presented from all viewing angles.

Certain groups of puzzle pieces can be coloured differently from other groups, i.e. the borders thereof and the plain coloured surfaces can be coloured differently between groups.

Then, when the stacked puzzle is completed and the pieces are therefore correctly stacked to form a sculpture defining in relief a recognisable image, the viewable areas, of the border region 1150 of each piece 1112, together form a recognisable colour bands in the stacked puzzle.

In a further preferred embodiment of the invention, the borders and plain coloured surfaces may be patterned so that the edges of the stacked pieces vary in colour around the periphery thereof to give a recognisable colour image in the viewable areas of the border regions which correspond with surface features in the three dimensional shape of the image defined in relief by the stacked pieces 1112, the viewable border regions giving the impression of providing the image defined in relief with colour.

Furthermore, although this embodiment has been described as having a colour image printed in the border region 1150, it would be apparent to the skilled person that, instead of applying colour to the border region 1150, simply applying a black and white, or greyscale image would also provide enhanced appearance of the resulting sculpture formed from stacked puzzle pieces 1112.

What is claimed is:

1. A puzzle comprising:

a plurality of planar puzzle pieces which can be assembled together into at least one planar jigsaw puzzle, each planar piece having on a first planar surface thereof a part of an image which is shown as a whole in the assembled planar jigsaw puzzle;

each planar puzzle piece has a first edge of a first profile shaped such that when the puzzle pieces are stacked in a correct sequence then the first edges of the stacked puzzle pieces together define in relief a recognisable image on a first side of the stack; and the puzzle pieces are shaped such that the correct stacking sequence is directly related to the locations of the puzzle pieces in the assembled planar jigsaw puzzle.

2. A puzzle as claimed in claim 1 further comprising the puzzle pieces in the completed planar puzzle are divided into columns and where two puzzle pieces are adjacent in a column they are also adjacent when correctly stacked.

3. A puzzle as claimed in claim 1 further comprising the puzzle pieces in the completed planar puzzle are divided into rows and where two puzzle pieces are adjacent in a row then they are also adjacent when correctly stacked.

4. A puzzle as claimed in claim 1 each planar puzzle piece comprising one from the group consisting of:

a pair of lugs on opposed sides;

a pair of lug-holes on opposed sides; and a lug on one side and a lug-hole on an opposed side;

wherein the lugs fit into lug-holes in the completed planar puzzle to interlock the puzzle pieces.

5. A puzzle as claimed in claim 4 one or more puzzle pieces comprising a plurality of sub-pieces which either abut each other without interlocking or which have lugs and/or lug-holes shaped differently to the lugs and/or lug-holes interconnecting the puzzle pieces with adjacent puzzle pieces.

6. A puzzle as claimed in claim 4 further comprising a frame having a first upright having a slot with which aligned lugs of stacked puzzle pieces are inserted and a ridge which extends into aligned lug-holes of the stacked puzzle pieces.

7. A puzzle as claimed in claim 1 wherein when the puzzle pieces are correctly stacked a single puzzle pieces provides a majority of layers.

8. A puzzle as claimed in claim 1 at least one of the puzzle pieces comprising a second edge of a second profile, wherein the second profile is complementary to the first profile of a puzzle piece adjacent in the assembled planar jigsaw puzzle, the second edges together defining in relief a recognisable image on a second side of the stack when the puzzle pieces are stacked in a pre-determined sequence.

9. A puzzle as claimed in claim 8 further comprising the first and second edges are on opposing sides of each puzzle piece.

10. A puzzle as claimed in claim 1 wherein at least one puzzle piece comprising a third edge and a fourth edge, the third and fourth edges having interlocking means for securing the puzzle piece in position in the completed planar jigsaw puzzle.

11. A puzzle as claimed in claim 10 further comprising the puzzle pieces are arranged in the completed planar puzzle in a plurality of columns, the third and fourth edge interlocking means of each puzzle piece engaging with the interlocking means of a piece in an adjoining column.

12. A puzzle as claimed in claim 1 further comprising one or more frame sections which extend along at least a part of a periphery of the puzzle pieces when assembled in the completed planar puzzle, at least one of the frame section(s) having an interlocking means which interlock with an adjacent puzzle piece in the assembled planar puzzle.

13. A puzzle as claimed in claim 1 further comprising a base and a core extending upwardly from the base, the core extending through apertures in the stacked puzzle pieces to retain the stacked puzzle pieces in place on the base.

14. A puzzle as claimed in claim 1 further comprising a base and a plurality of cores extending upwardly from the base, the cores extending through apertures in the stacked puzzle pieces to retain the stacked puzzle pieces in place on the base.

15. A puzzle as claimed in claim 13 the base comprising an attachment means which permit mounting of the base suspended on a vertical surface.

* * * * *